United States Patent [19]

Kurabayashi et al.

[11] 3,938,619

[45] Feb. 17, 1976

[54] STANCHION

[75] Inventors: Kinji Kurabayashi, Kawasaki; Tatsuo Ono, Tokyo, both of Japan

[73] Assignee: Nisso-Sangyo Co. Ltd., Japan

[22] Filed: Aug. 15, 1972

[21] Appl. No.: 280,765

[30] Foreign Application Priority Data

Nov. 12, 1971 Japan ..... 46-105765

[52] U.S. Cl. ..... 182/113; 256/59; 248/226 A

[51] Int. Cl.[2] ..... E04H 17/14; E04G 1/26

[58] Field of Search ..... 182/113; 256/65, 59; 24/263 PI, 263 C; 248/226, 316

[56] References Cited

UNITED STATES PATENTS

| | | | |
|---|---|---|---|
| 2,706,662 | 4/1955 | Brown | 182/113 |
| 3,084,759 | 4/1963 | Squire | 182/113 |
| 3,351,311 | 11/1967 | Melfi | 256/65 |
| 3,480,257 | 11/1969 | Bourn | 182/113 |
| 3,756,568 | 9/1973 | Mocny | 256/65 |

FOREIGN PATENTS OR APPLICATIONS

| | | | |
|---|---|---|---|
| 767,212 | 1/1957 | United Kingdom | 182/113 |

*Primary Examiner*—Reinaldo P. Machado
*Attorney, Agent, or Firm*—McGlew and Tuttle

[57] ABSTRACT

A stanchion adapted to expand by means of the inner as well as outer tubes and the clamping mean so that it enables a clamping of scaffolding or any other mounting base, which clamping is performed by sliding the inner and outer tubes relatively and/or by adjusting a clamping means together with the tubes or independently.

1 Claim, 7 Drawing Figures

STANCHION

The invention relates to a stanchion, more particularly to a stanchion or a supporting post suitable to be applied as the handrail easily attachable to the scaffolding for workers and working machines used for construction cites of architecture, ship building and repair, engineering work of roads and tunnels, etc.

In general, upon building construction and ship building, assembly and repair or engineering work of roads and tunnels most works are performed by using scaffolding considerably higher than ground surface. Handrails are provided to such scaffoldings by equipping stanchion having pipes or ropes, which scaffoldings are assembled by arranging plates to the side of such objects to be constructed or repaired in order to enable the safe movement of workers or operating machinery such as crane and others. As for road paving works, wires or ropes are stretched in order to limit construction cite and at the same time to keep off pedestrians and cars.

In order to stretch ropes, wires, pipes and others to limit scaffoldings or construction cite, it is inevitable to stand stanchion for securing such ropes and others at their tops or sides. To provide scaffolding and construction cites with such stanchion, welding to other steel materials, clamping by using bolts and nuts, binding by ropes or any other methods are applied, which not only require very troublesome works upon their installation and removal lowering working efficiency but also are very uneconomical because of the requirement of many workers, tools and components.

Moreover, depending upon the condition of the construction cite many posts different in length are often required corresponding to the height to stretch supporting medium, which results in much more expense by requiring larger number of components differing in length. Further, when the thickness of the plates used for scaffolding are various, it is inevitable to use the stanchions respectively corresponding to such plates. In addition, the fixing of such ropes or wires to stanchions by knotting also results in bad economy of operation together with very low operative efficiency.

The main purpose of this invention is to provide with a stanchion very easily mountable and detachable to and from scaffolding plates, which stanchion is very excellent in economy and operating efficiency.

The another purpose of this invention is to provide with a stanchion freely mountable and detachable to and from scaffolding plates, which plates are various in thickness.

The further purpose of this invention is to provide with stanchion easily mountable to scaffolding plates notwithstanding such plates are horizontal, inclined or vertical.

More further object of this invention is to provide with a stanchion easily adjustable of its length corresponding to the condition to be used.

More further object of this invention is to provide with a stanchion, to which the stretching means such as rope, wire and others can be fixed by one-touch motion by means of fitting equipped to the stanchion.

In the annexed drawings the embodiment according to this invention is shown, the invention now being more fully explained with reference to said drawings.

Figure 1:
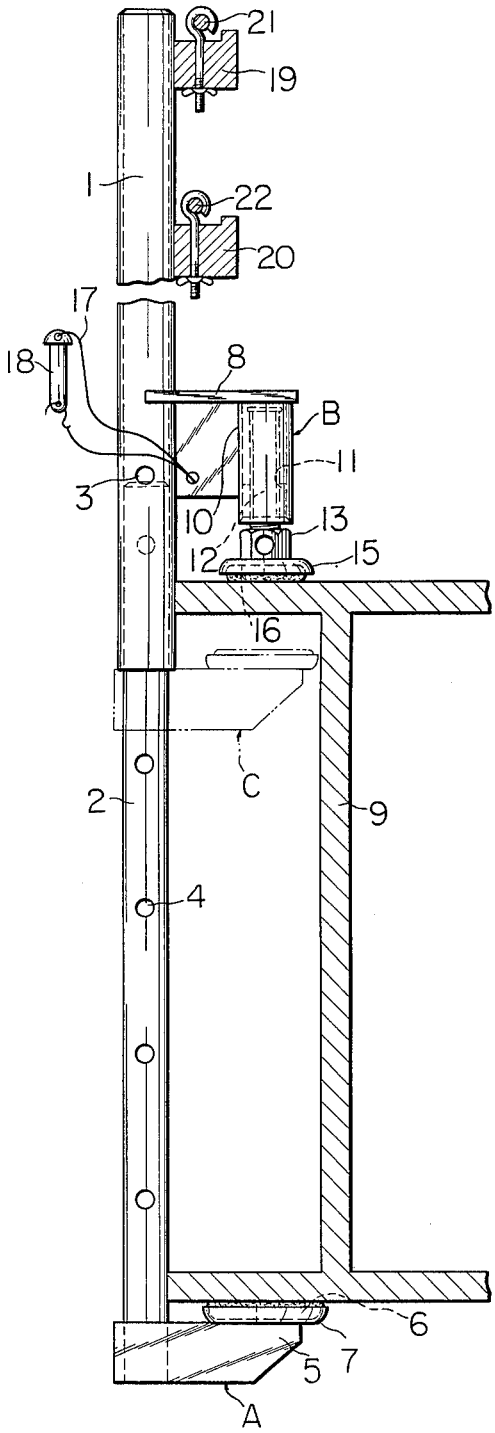
FIG. 1 shows a side view of an embodiment of the stanchion designed expansible according to this invention and mounted to a scaffolding plate.
Figure 2:
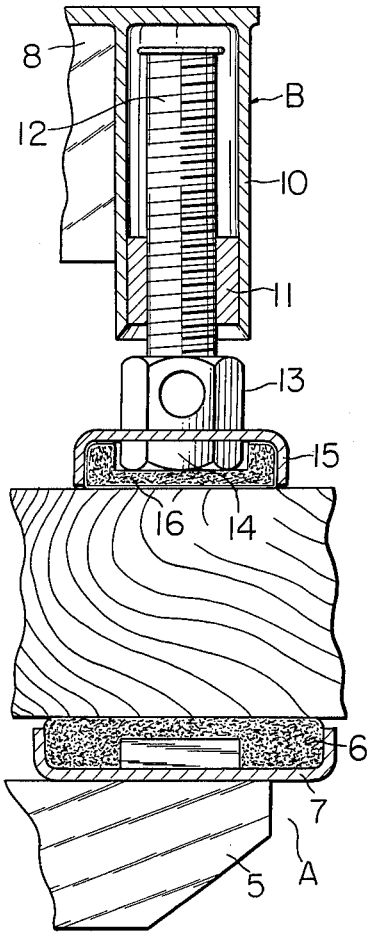
FIG. 2 shows an enlarged cross sectional view of a clamping mean of the embodiment indicated in FIG. 1.

The preferred embodiment of the invention shown in FIGS. 1 and 2 includes a stanchion comprising an inside tubular body (2) which is vertically slidably inserted into a hollow outer tubular body (1). The outer body (1) is provided with a plurality of holes (3) located at equally spaced vertical distances along its height. The inner tubular body is also provided with holes in correspondence with the holes provided to the outer tubular body (1) in an equal distance. To the lower extreme of said inner tube (2), a bracket (5) extending laterally is fixed and on the upper surface of said bracket (5), a dish (7) filled with elastic material (6) such as hard rubber and other is fixed. The bracket (5), the dish (7) and the elastic material (6) form the lower part (A) of clamping means.

The clamping means include a freely expansible upper part (B) which mean is fixed through a bracket (8) and extend downwards. The clamping means constituted by said lower part (A) and lower part (B) is adapted to clamp a scaffolding plate (9) from both side of the plate.

The upper part (B) of said clamping mean comprises a cylindrical body (10) and a nut (11) fixed within said cylindrical body (10). A bolt (12) is engaged with said cylindrical body (10) through the nut (11) and may be threadably adjusted therein vertically. To the lower extreme of the bolt (12), a dish (15) is fixed through the head portion (13) of the bolt (12) and a nut (14) free to make rotative motion without changing its vertical position. An elastic material such as hard rubber (16) is filled in the dish (15). A pin (18) is connected with said bracket (8) through a chain (17) and is adapted to engage with said holes (3) and (4) by insertion. The stanchion according to the invention is mounted to a scaffolding (9) through following steps.

In case when the thickness of a scaffolding (9) is considerably large, said inner tube (2) is slidingly extended corresponding to the thickness of the scaffolding (9) and at the location to oppose the hole (3) of said outer tube (1) with the hole (4) of said inner tube (2), a pin (18) is pierced through said holes (3) and (4) to fix said inner tube (2). Through such arrangement, it is possible to determine the length of a stanchion constituted from the outer tube (1) and the inner tube (2).

Succeedingly, the elastic material (6) of the lower clamping mean (A) is applied to the lower surface of said scaffolding (9) and the upper clamping mean (B) is located opposing to the upper surface of said scaffolding (9). Thereafter, the elastic material (16) is applied by rotating the head (13) of said nut (12) and lowering it. As they result, the scaffolding (9) is tightly clamped by means of said upper and lower parts (A) and (B) of the clamping mean to fix the outer and inner tubes (1) and (2) tightly to said scaffolding (9). In case when the thickness of a scaffolding (9) is considerably small, it is possible to mount the stanchion to the scaffolding (9) simply only by sliding said inner tube (2) upwards and by adjusting the upper part (B) of the clamping mean.

After the completion to mount the stanchion to the scaffolding (9), it is possible to form a handrail by attaching ropes (21) and (22) to fittings (19) and (20) provided on the upper portion of said outer tube (1).

Figure 3:
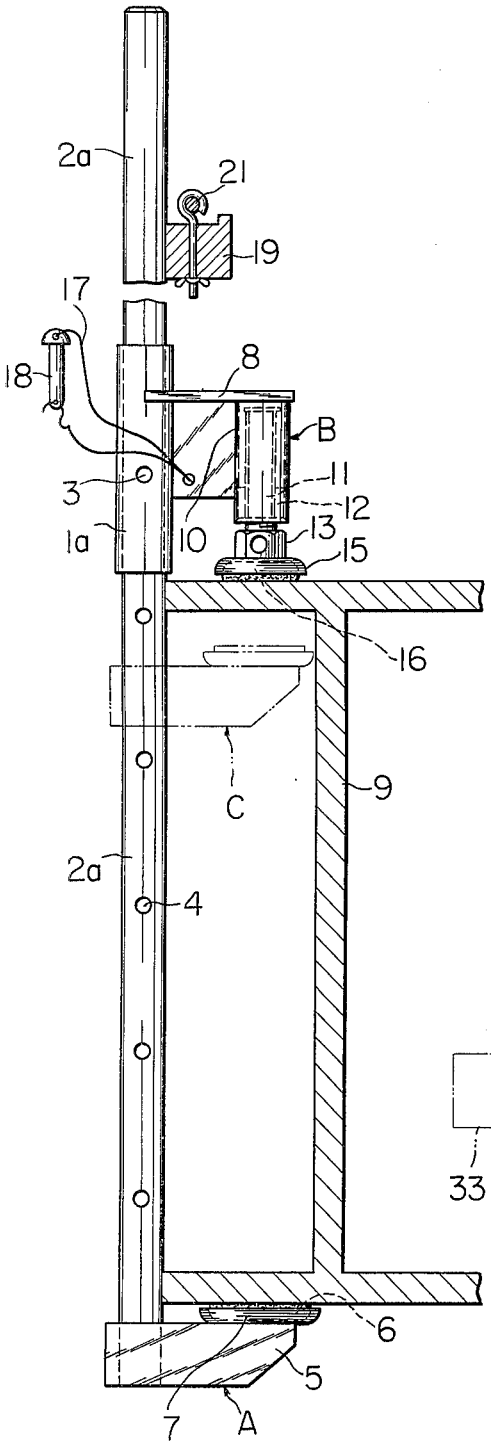
FIG. 3 shows a side view of another embodiment according to this invention.

The stanchion shown in FIG. 3 is substantially similar to the embodiment shown in FIGS. 1 and 2 excluding an inner tube (2*a*) of considerably larger length. The configuration is suitable to be applied to the working cite which does not require to adjust stanchion length.

In the embodiment shown in FIG. 3, an inner tube (2*a*) is inserted through a short outer tube (1*a*) slidably and an upper portion (B) of clamping mean is fixed to said outer tube (1*a*). In this case, the outer tube (1*a*) is adapted to slide vertically on the outer surface of said inner tube (2*a*) in order to adjust the height of the upper part (B) of clamping mean. Other configuration of this embodiment including lower part (A) of clamping mean, holes (3) and (4), fitting (19) for rope and pin (18) is completely similar to the embodiment shown in FIGS. 1 and 2 together with the operational procedure.

Figure 4:
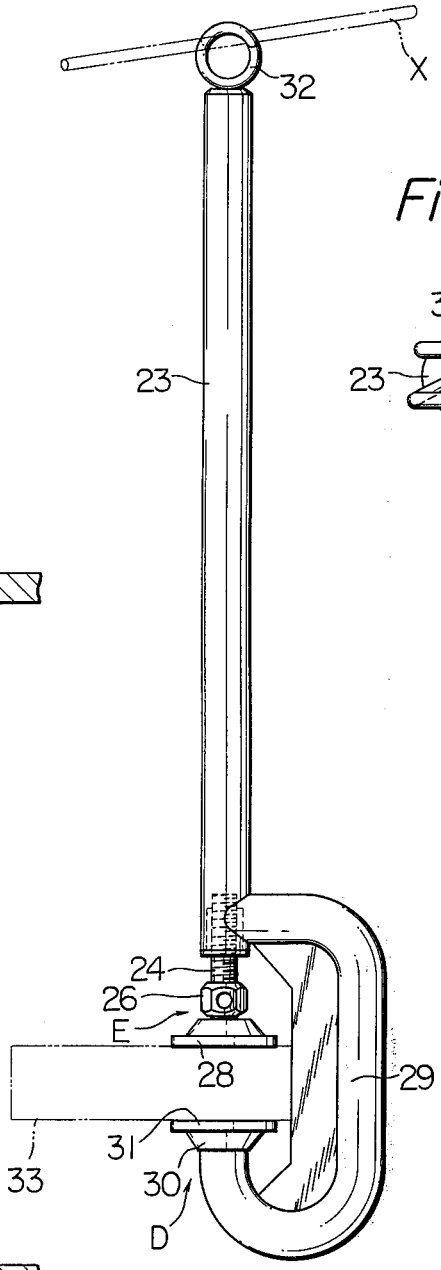
FIG. 4 shows another embodiment of the stanchion with modified clamping mean according to this invention.

The stanchion shown in FIG. 4 is an embodiment with a modified clamping mean, which is characterized by providing the upper part (E) and lower part (D) of clamping mean on the extended line of stanchion axis line. In this configuration, to the lower end of a hollow post (23), a bolt (24) is mounted free to move vertically by thread engagement and to the lower end of said bolt (24), a clamping base (27) having a shape of downwardly expanding bellmouth is fixed through the head (26) of the bolt. Moreover, to the extreme end of said base (27), a cushioning elastic material (28) is provided to form the upper portion (E) of clamping mean together with said bolt (24), clamping base (27) and cushioning material (28). A C-shaped supporting member (29) is fixed to the lower end of said post (23) at one end and to the another end of said member (29), a clamping base (30) having a shape of upwardly extending bellmouth and located on the extended axis line of said stanchion. At the upper surface of said base (30), an appropriate elastic material (31) is fixed so as to form a lower part (D) of clamping mean together with said clamping base (30) and elastic material (31).

Figure 5:
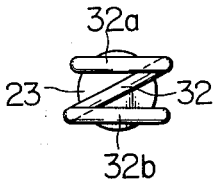
FIG. 5 shows a plan view of a fitting for tightening the stretching rope provided to the stanchion shown in FIG. 4.

At the upper extreme of the stanchion (23) shown in FIG. 5, a fitting (32) for pipe or rope mounting is fixed, which mounting member (32) is formed to a ring-shape of its side and the extreme ends (32*a*) and (32*b*) of the member are opposed by appropriate gap so as to enable an one-touch mounting of ropes within said mounting member (32) through a gap provided therebetween.

As to the embodiment of stanchion mentioned above, a scaffolding plate (33) is inserted between said upper and lower clamping bases (27) and (30) and the end of said scaffolding plate (33) is engaged with the inside of said C-shaped supporting member while the bolt (24) is rotated by means of its head (26) so as to lower said upper clamping mean (E) and to clamp the both surfaces of said scaffolding plate by means of said elastic materials (28) and (31) enabling the tight mounting of the stanchion to the scaffolding plate (33). It is possible to form a handrail by inserting a rope or a pipe into said mounting member (32) under the condition as mentioned above.

Figure 6:
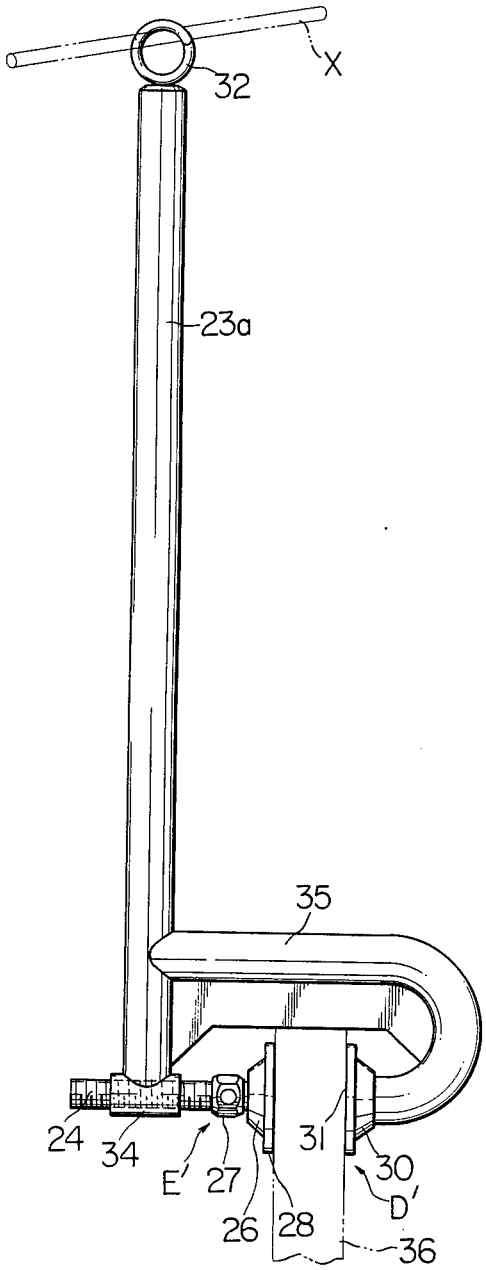
FIG. 6 shows a side view of an expansible stanchion modified from the embodiment shown in FIG. 4.

In an another embodiment shown in FIG. 6, a stanchion is formed by an substantially similar way as of the embodiment shown in FIG. 4, while in this case the mounting position of the clamping mean of stanchion is vertical.

In the embodiment shown in FIG. 6, a cylindrical body (34) is fixed horizontally at the lower end of a stanchion (23*a*). A bolt (24) is inserted through said cylindrical body (34) free to move in the lateral direction by thread engagement. On the right end of said bolt (24), a clamping base (26) of bellmouth shape is fixed by way of head (27) free to make rotary motion. An elastic material (28) is fixed to the end of said clamping base (26) to form one side clamping mean (E′) together with said bolt (24), bellmouth-shaped clamping base (26). To the lower portion of the stanchion (23*a*), a horizontal supporting member (35) having J-shape is fixed and to the extreme end of said member (35), a clamping base (30) having bellmouth shape is fixed in an opposition to said bellmouth-shaped clamping base (26) forming a complete clamping mean (E′). Said clamping base of bellmouth shape (30) is covered with an elastic material (31) to form another part of the clamping mean.

In the embodiment shown in FIG. 6, a member to be mounted (36) is inserted between said two parts of clamping mean (E′) and (D′) and upon abutment of the extreme end of said member (36) with the said J-shaped member (35), the bolt (24) is rotated to make rightward motion so as to clamp said member (36) by means of said two parts (E′) and (D′) of clamping mean and to complete the tight mounting of a stanchion (23) to the member (36) upright. This configuration is appropriate to mount a stanchion to a member standing upright.

A fitting for rope or pipe installation is mounted to the upper end of said stanchion (23*a*).

Figure 7:
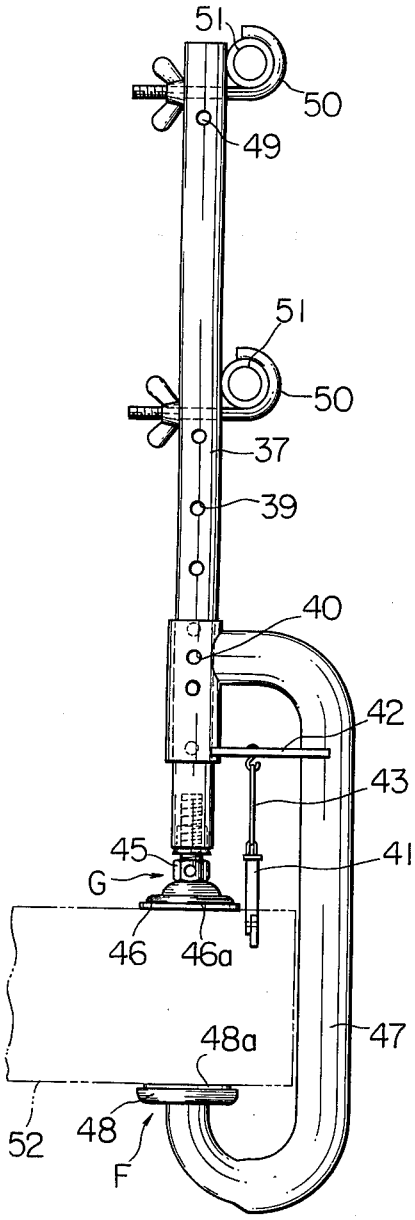
FIG. 7 shows a side view of another embodiment of the stanchion with the clamping mean having changed its location.

In an embodiment shown in FIG. 7, as a modification of the embodiment shown in FIG. 4, a stanchion is constructed so as to cope with the situation, in which the thickness of the member to be mounted is too thin or too thick to clamp by means of fine adjustment of the clamping system as mentioned above. In this case, the supporting post itself is constructed slidably so as to adjust the clamping width. In such case, the inner tube to be used as stanchion (37) is slidably inserted into an outer tube (38) of appropriate length. These tubes are fixed at the suitable location for required length by inserting a pin through holes (39) and (40) provided to each of the tubes (37) and (38). Said pin (41) is connected to the reinforcing piece (42) mounted to the outer tube (38) by means of string (43). With the lower end of post (37) a bolt (44) is engaged free to make vertical motion and a clamping base (46) is fixed to said bolt (44) by way of the head (45) of said bolt (44). An elastic material (46*a*) covers or fills the clamping base (46). An upper portion (G) of a clamping mean is formed by the bolt (44), clamping base (46) and the elastic material (46*a*). C-shaped or J-shaped supporting rod member (47) is fixed to said outer tube (38) by welding at upper end and the another end of said member (47) has a clamping base (48) fixed opposing to said clamping base (46) and covered or filled with an elastic material (48*a*) to form lower portion of a clamping mean (F). A hole or holes (49) is provided to the upper portion of said post (37) to be engaged with hookbolt (50) so as to mount rope or pipe (51).

In the stanchion as shown in FIG. 7, when the thickness of a scaffolding plate (52) is remarkably large, it is possible to clamp such plate by sliding the outer tube (38) downwards to lower the supporting member (47) so that the gap between clamping bases may widen and by clamping tightly the scaffolding plate (52) inserted therebetween by means of upper and lower portions (F) and (G) of clamping mean after the fine adjustment with said bolt (44). By providing said hookbolt (50) with pipe or rope (51), it is possible to form a completed handrail or any other assembly of building materials.

It is to be understood that there are many possible variations on the aforesaid installation without departing from the spirit and scope of this invention.

What is claimed is:

1. A stanchion construction for clamping to a scaffold plate, comprising vertical support means including first and second vertically extending tubular support members, means for fixing said first and second support members in an adjusted telescopic position with one of said members extending outwardly from the other of said members by a predetermined amount, clamping means carried by said first and second tubular support members including a threaded cylinder on said first tubular support member, a bolt threaded into said cylinder and having an outer end with a first flat engagement surface, a second flat clamping surface carried by said second tubular member and parallel to and opposed to said first clamping surface, said bolt being threadably adjustable to move said first clamping surface toward and away from said second clamping surface, said first tubular member having a hand rail and at least one fitting extending outwardly from said first tubular member and having means thereon for supporting said hand rail at a spaced location above said first clamping surface.

* * * * *